US006595561B1

(12) United States Patent
Szablewski et al.

(10) Patent No.: US 6,595,561 B1
(45) Date of Patent: Jul. 22, 2003

(54) CLOSURE, ESPECIALLY FOR VEHICLES

(75) Inventors: Piotr Szablewski, Wuppertal (DE); Joachim Barthel, Essen (DE)

(73) Assignee: Huf Hülsbeck & Furst GmbH & Co. KG, Velbert (DE)

( * ) Notice: Subject to any disclaimer, the term of this patent is extended or adjusted under 35 U.S.C. 154(b) by 0 days.

(21) Appl. No.: 09/701,410

(22) PCT Filed: Jun. 1, 1999

(86) PCT No.: PCT/EP99/03789

§ 371 (c)(1),
(2), (4) Date: Nov. 28, 2000

(87) PCT Pub. No.: WO99/67490

PCT Pub. Date: Dec. 29, 1999

(30) Foreign Application Priority Data

Jun. 25, 1998 (DE) ..... 198 28 289

(51) Int. Cl.[7] ..... E05C 19/00

(52) U.S. Cl. ..... 292/304; 292/202; 292/209; 292/341.15; 292/341.16; 292/341.17

(58) Field of Search ..... 292/202, 207, 292/209, 330, 336, 341.15, 341.16, 341.17, 304; 296/224

(56) References Cited

U.S. PATENT DOCUMENTS

| | | | | | |
|---|---|---|---|---|---|
| 2,031,302 | A | * | 2/1936 | Clark | 292/304 |
| 2,286,740 | A | * | 6/1942 | Krause | 292/336 |
| 2,533,360 | A | * | 12/1950 | Dath | 292/207 |
| 2,723,552 | A | | 11/1955 | Dlugatch | 70/240 |
| 2,779,615 | A | * | 1/1957 | Kaiser | 292/221 |
| 2,795,450 | A | * | 6/1957 | Claud-Mamtle | 292/304 |
| 2,796,274 | A | * | 6/1957 | Sigel | 292/223 |
| 4,325,239 | A | * | 4/1982 | Larson | 70/139 |
| 4,893,850 | A | * | 1/1990 | Mizusawa | 292/128 |
| 5,172,945 | A | | 12/1992 | Doherty et al. | 292/49 |
| 5,457,971 | A | * | 10/1995 | Yamada | 70/208 |
| 5,735,557 | A | * | 4/1998 | Harvey | 292/216 |

FOREIGN PATENT DOCUMENTS

| | | |
|---|---|---|
| EP | 0361679 | 4/1990 |

* cited by examiner

*Primary Examiner*—Anthony Knight
*Assistant Examiner*—John B Walsh
(74) *Attorney, Agent, or Firm*—Friedrich Kueffner

(57) ABSTRACT

The invention relates to a closure comprising a closing head (20) and a lock (10) which rest on the immobile or mobile part of a door, flap or such like. The closing head (20) has an undercut axial shoulder (26) which during coupling is engaged by a radially mobile blocking member (11) in the lock (10). The lock (10) further comprises a sensing member (12) and a restoring member (13) for the blocking member (11). To make the lock less prone to malfunctions the invention provides for the axially spring-loaded sensing member (12) to be used as a locking means for the radially spring-loaded blocking member (11). When the locking effect is actuated the blocking member (11) is held in a release position in relation to the closing head (20). When the closing head (20) is engaged the sensing member (12) carries out an axial movement which releases the lock so that the radial spring-loading can move the blocking member (11) into its blocked position. Actuation of the restoring member (13) results in a radial reverse movement of the blocking member (11), which activates the locking of the sensing member (12) and locks the blocking member (11) in its release position.

12 Claims, 5 Drawing Sheets

III
30
34
43
36
37
58
44
35
38
33
39
48
42
28
26
20
46
47
27
25
29
32
24
23
22
21
10
49
40
19
65
62
61
11
41
73
55
64
63
60
60'
12
45
77

CLOSURE, ESPECIALLY FOR VEHICLES

BACKGROUND OF THE INVENTION

1. Field of the Invention

The invention relates to a closure between the movable and the stationary part of a door, a flap or the like, especially for vehicles, such as a hinged rear window of a motor vehicle, comprising a lock on one, especially the stationary, part of the flap and with a closing head movable axially relative thereto on the other, especially the movable, part of the flap, wherein the closing head comprises an undercut axial shoulder for a radially movable locking member of the lock which is spring-mounted in a direction of its movement axis, and the locking member in the coupling situation of the closing head engages behind the axial shoulder and is then in a locked position, and the lock, in addition to the locking member, has an axially spring-mounted sensing member and a return member for the locking member, wherein the sensing member projects into the axial movement path of the closing head and is actuated by the closing head, while the return member moves the locking member into a release position relative to the closing head, in which the closing head can be decoupled.

2. Description of the Related Art

In the case of vehicles the closure can be used, for example, on the hinged rear window. The closure comprises a closing head and a lock which are coupled with one another upon closing the rear window. In the coupling situation, the spring-action locking member engages behind an axial shoulder of the closing head which characterizes the locked position of the closure. For decoupling the closing head, the locking member is transferred by a return member into a release position where the closing head can again be decoupled from the lock and the rear window can be transferred into the open position.

In the known closure, the closing head comprises on its free end portion a control surface which extends at a slant to the axial movement direction and has the task to push away the locking member against its spring force during coupling of the closing head. The locking member was subjected to axial loads. The pushing away action of the locking member by the closing head resulted in friction and thus in wear. After extended use disturbances caused by wear resulted which could be remedied only in a cumbersome way by after-adjustment. Moreover, the closure also had an axially spring-loaded sensing member which had the task to cooperate with a sensor. The sensor had the task to initiate further functions within the vehicle, for example, activation of the theft alarm. The sensing member therefore had its own function relative to the locking member. Both components had no functional connection with one another.

SUMMARY OF THE INVENTION

The invention has the object to develop an inexpensive, space-saving closure of the aforementioned kind which is characterized by high reliability and minimal failure liability. This is achieved according to the invention by the sensing member being a locking means for the locking member and the locking member being secured by it in a release position until the closing head is decoupled, wherein the axial movement of the sensing member resulting during coupling of the closing head releases the locking action so that the radial spring load transfers the locking member into its locking position, and wherein the radial return movement of the locking member resulting from actuation of the return member activates the locking action of the sensing member and locks the locking member in its release position.

According to the invention, the sensing member takes on the new function to realize a locking means for the locking member. As long as the closing head is decoupled, the sensing member blocks the release position of the locking member. This allows for a wear-free coupling and decoupling of the closing head without the locking member having to be moved by the closing head. The movement of the locking member occurs instead only when the full coupling position of the closing head in the lock is reached. This is realized automatically. Upon insertion, the closing head impacts on the sensing member which, because of its axial spring action, follows this axial movement of the closing head. The moved sensing member releases the locking action so that the locking member is transferred by its radial spring loading into its locking position in which it engages behind the closing head. The locking of the locking member by the sensing member occurs automatically again once the locking member is returned into its release position upon actuation of the return member. This establishes again the initial state.

BRIEF DESCRIPTION OF THE DRAWINGS

Further measures and advantages of the invention result from the further claims, the following description, and the drawings. In the drawings, the invention is illustrated by one embodiment. It is shown in:

DESCRIPTION OF PREFERRED EMBODIMENTS

Figure 6:
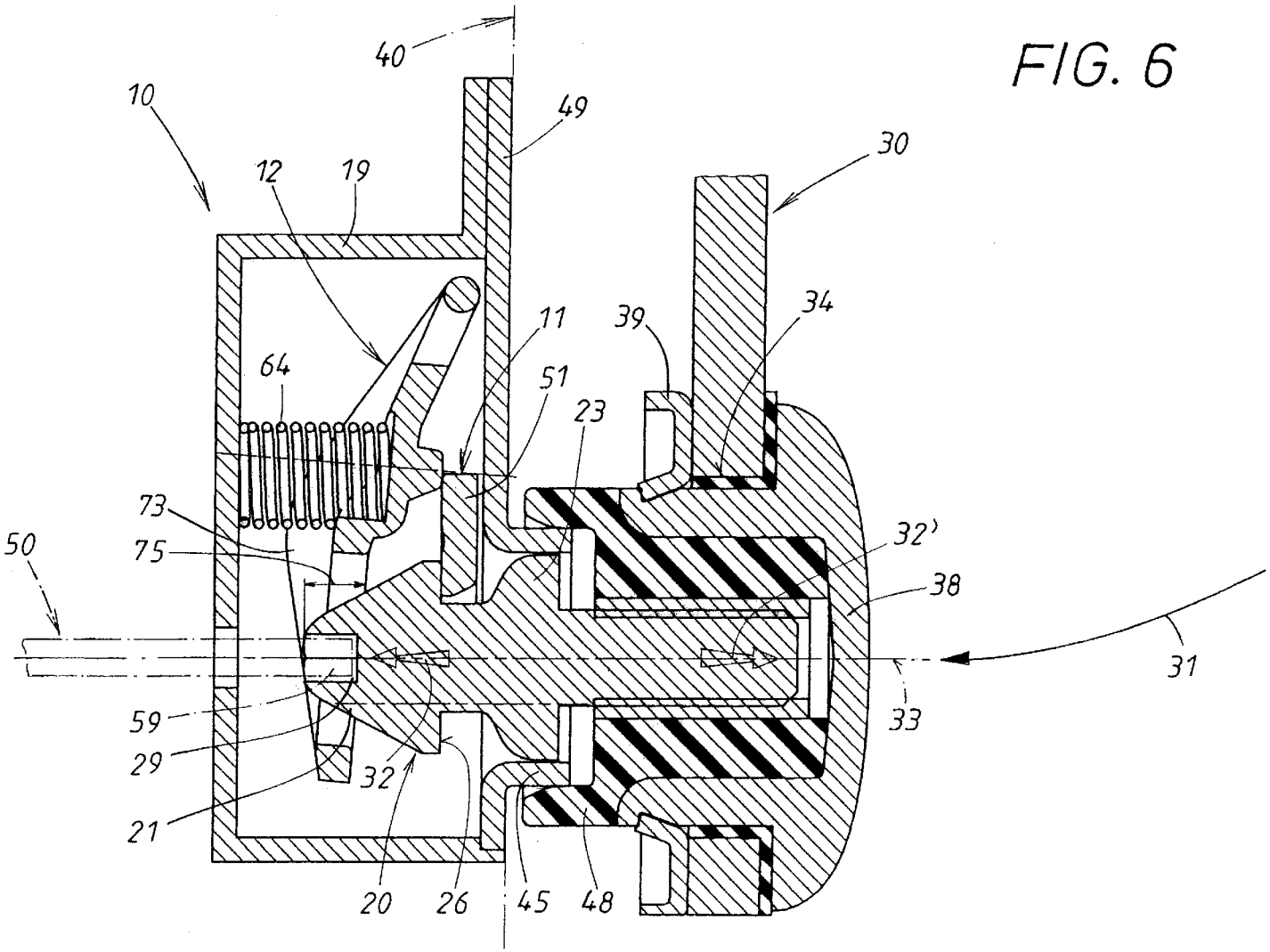
FIG. 6 in a section illustration corresponding to FIG. 1 the coupling situation of the closing head in the lock according to FIG. 5, for which purpose the corresponding section line VI—VI has been indicated in FIG. 5.

The closure 10, 20 according to the invention is used in the embodiment for a hinged rear window 30, which is illustrated in FIG. 6, of a motor vehicle. The rear window 30 is pivotable along the arc-shaped path illustrated at 31 in FIG. 6. The closure is comprised of a lock 10—relative to the rear window movement 31 which is arranged on the stationary part 40 of the motor vehicle, i.e., on the rear part 40 of the motor vehicle indicated in dashed lines in FIG. 6. The closure further comprises a closing head 20 which is connected to the window 30 and is guided together with it along the hinged movement path 31. In the last phase of the hinged movement 31, the closing head 20 carries out the movement which is determined by the tangent according to arrow 32 of FIG. 6 which, for a simpler description of the other movements, is referred to in the following as the "axial movement direction" or the "axial decoupling movement" of the closing head 20. The drawing plane of FIG. 6 is the plane of the pivot movement 31 of the window 30 with closing head 20 connected thereto.

Figures 1, 2:
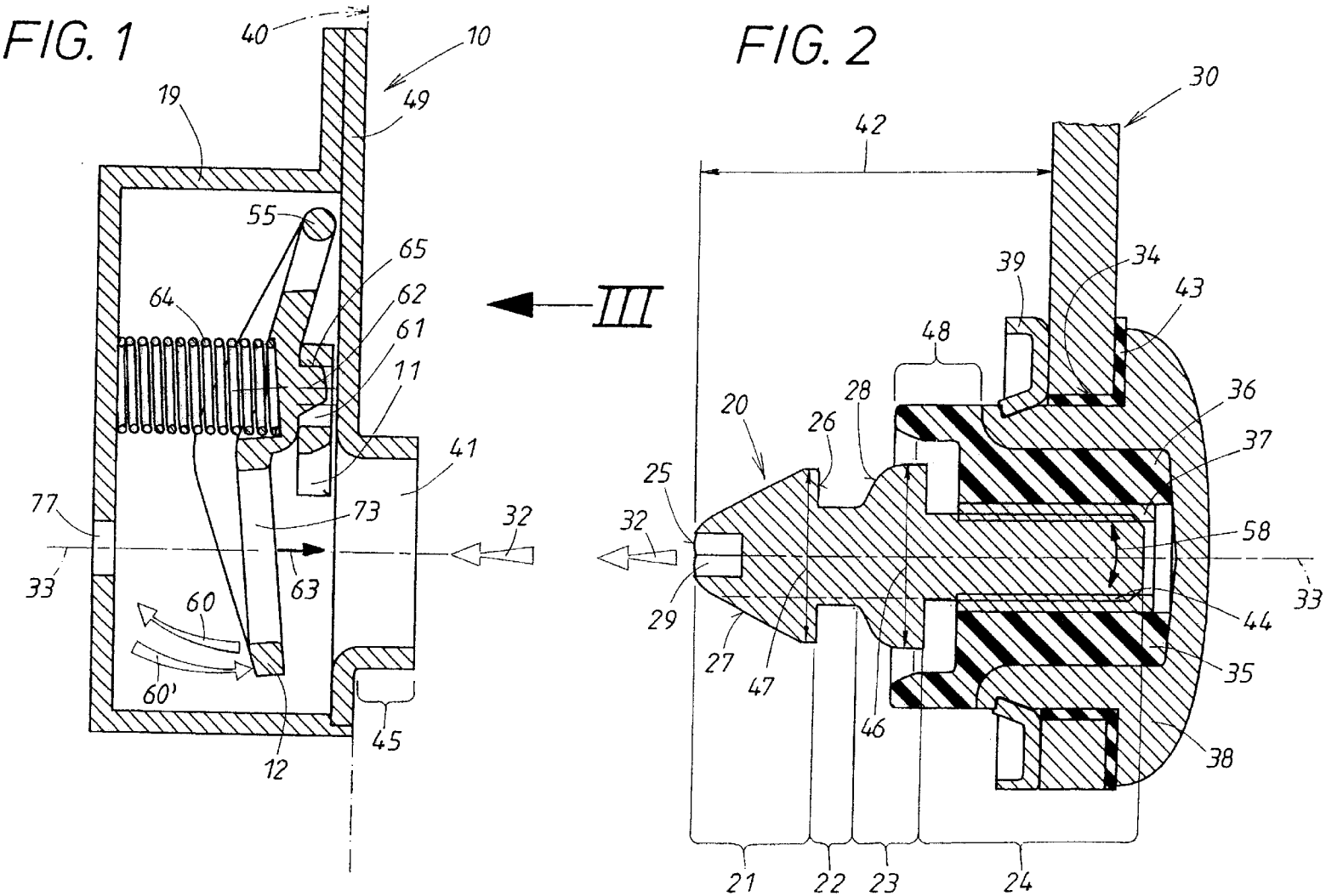
FIG. 1—in the coupling situation—a section of the lock of the closure according to the invention along the section line II—II of FIG. 3 or FIG. 4.
FIG. 2 an axial section of the closing head belonging to the closure according to the invention, which is fastened on a hinged part, i.e., the rear window of a vehicle.

The movable component 20 referred to as "closing head" can be formed in the shape of an axial projection with non-round radial profile. In the present situation this component 20 is, however, designed with radial symmetry to an axis 33 extending in the direction of movement 32. The closing head 20, as illustrated in FIG. 2, can be divided into four portions 21 to 24. They include a forward end portion 21 which is conically shaped in this embodiment. The end portion 31 tapers toward the front end face 25 of the closing head 20. The end face 25 is spherical. The conical end portion 21 provides a slanted control surface 27 which, because of the aforementioned radial-symmetrical embodiment of the closing head 20, is provided on all sides.

A constriction 22 in the closing head 20 adjoins this end portion 31 and produces an undercut axial shoulder 26 at the transition to the end portion 21. Behind the constriction 22 a cylindrical portion 23 is arranged which, in the direction toward the constriction, has a gliding slant 28 pointing in the movement direction 32 of the closing head 20. This gliding slant 28, because of the radial-symmetrical embodiment of the closing head 20 already mentioned several times, extends circumferentially about the closing head axis 33.

At the opposite end of the closing head 20 an axial mounting pin 24 is provided which is fastened in a receptacle 34 of the rear window 30. This attachment in the receptacle 34 is realized indirectly by a bushing 36 which is comprised of elastomer material 35 and has an integrated threaded sleeve 37. The mounting pin 24 provided with an outer thread 44 can be screwed into the inner thread of this threaded sleeve 37. The bushing 36 is seated in a window button 38 which is seated by means of a seal 43 in the window receptacle 34. The window button 38 is supported by means of one flange surface on one side of the rear window 30 and is fastened on the window 30 by a securing ring 39 which is supported at the opposite window side. The attachment of the securing ring 39 is realized on the circumference of a hollow shaft of the window button 38 which receives the bushing 36 and which, with interposition of the seal 43 is seated in the window receptacle 34.

The screw connection 37, 44 of the closing head 20 makes it possible to precisely adjust the closing head 20 with respect to its axial length 42, illustrated in FIG. 2, relative to the window 30. For this purpose, the closing head 20 has a non-round plug receptacle 29 at its front end face 25 for a rotational tool 50 shown in FIG. 6 and to be described infra.

Figure 3:
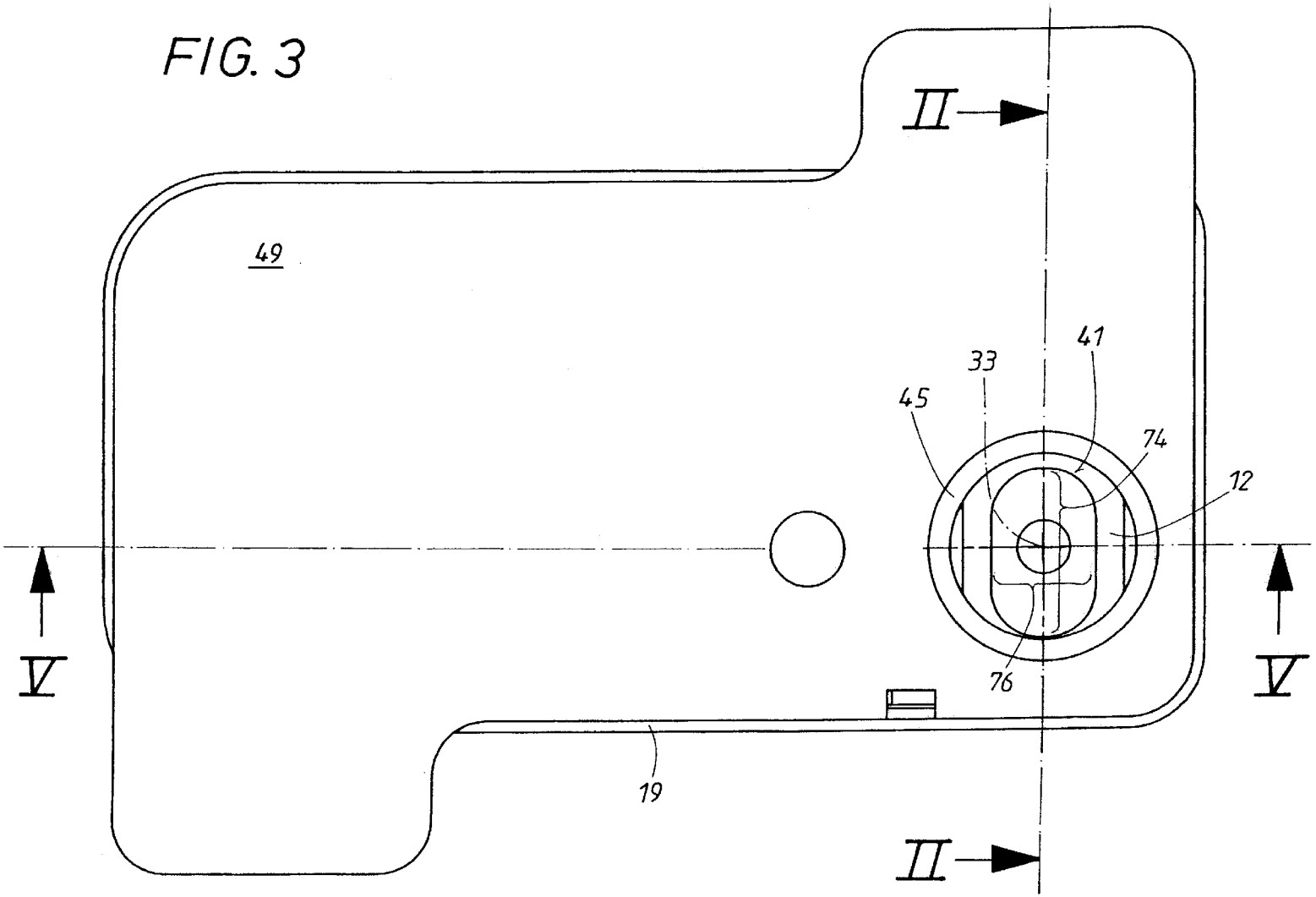
FIG. 3 a plan view onto the lock in the viewing direction III of FIG. 1.
Figure 4:
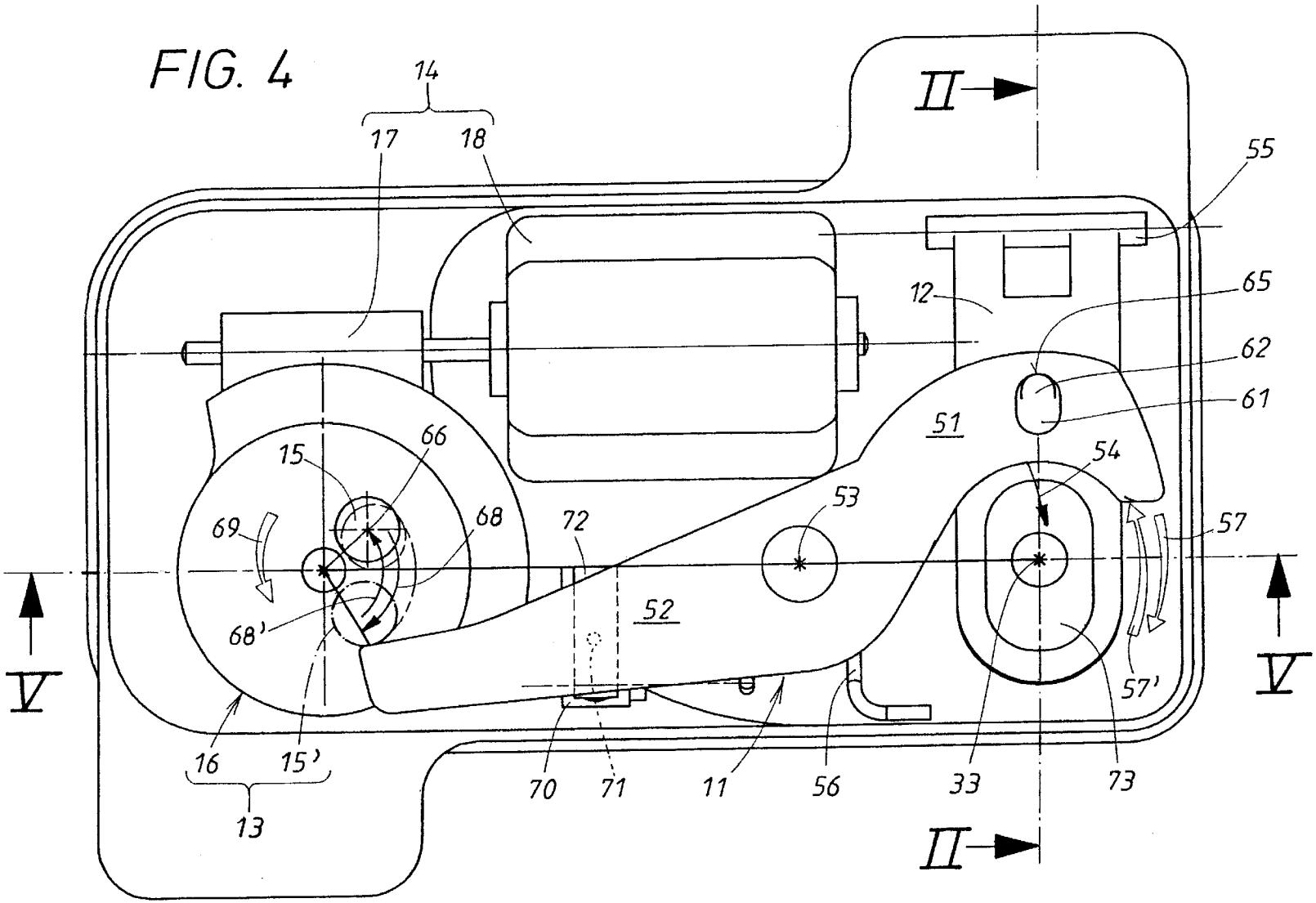
FIG. 4 a plan view onto the lock which corresponds to that of FIG. 3 but after the upper cover plate of the lock housing has been removed.

The lock 10 comprises, as can be seen best in FIG. 4, a locking member 11, a sensing member 12, a return member 13, and a motoric actuator 14 for the return member 13. These members 11 to 14 are positioned in the interior of a two-part housing 19, 49. The housing comprises, as best illustrated in FIG. 1, a housing half 19 which is closed by a housing cover 49. The housing cover comprises a coupling opening 41. This coupling opening 41, as illustrated in the plan view of FIG. 3, is circular and, in particular, coaxial to the axis 33 illustrated also in FIG. 1 which, as mentioned, determines the axial movement direction 32 of the closing head 20. The coupling opening 41 is surrounded by a tubular guide 45, illustrated in FIGS. 1 and 3, whose inner width is matched to the cross-section 46 of a cylindrical portion 23 of the closing head 20. The cross-section 46 is somewhat greater than the maximum cross-section 47 of the conical end portion 21 of the closing head 20, illustrated in FIG. 2.

Upon insertion of the closing head 20 into the coupling opening 41 of the lock 10 in the direction of arrow 32, an alignment movement relative to the lock 10 can already take place on the conical end portion 21. The described slanted control surfaces 27 of the conical shape cooperate with the tubular projection 45 surrounding the coupling opening 41. A centering of the closing head 20 is realized especially by the gliding slant 28 on the adjoining cylindrical portion 23 of the closing head 20. The tubular projection 45 acts as a guide receptacle for the cylinder portion 23 and secures its coaxial position in the coupling situation that can be seen in FIG. 6. The cylinder portion 23 rests with its circumference on the inner surface of the guide receptacle 45 of the housing 10. The bushing 36 has a coaxial annular projection 48 which can be seen in FIG. 2 and which, in the coupling situation of FIG. 6, elastically surrounds the tubular projection 45 of the lock. In the coupling situation of FIG. 6, the interior of the lock is sealed at 45, 48 relative to the surroundings against penetration of water and dirt.

The elastomer material 35 of the bushing 36 provides primarily a radially elastic securing action of the closing head 20 on the window 30. After extended use of the vehicle, the hinge for the aforementioned pivot movement 31 of the window 30 can result in a change of the pivot movement path 31 as a result of wear. In order for the aforementioned radial alignment movement on the control surfaces 27 or the gliding slants 28 to take place during coupling, the mounting pin 24 of the closing head 20 should carry out an alignment movement in the bushing 36 which is illustrated by the radial double arrow 58 in FIG. 2. This is so because the mounting pin 24 is radially elastically secured in the bushing 36 because of the resilience of the bushing material 35.

The locking member 11, as illustrated in FIG. 4, is formed as a two-arm lever 51, 52. This lever is seated on a pivot axle 53 which is positioned parallel to the axis 33 and which makes the lever arms 51, 52 radially movable relative to the axis 33. A two-legged locking spring 56 engages the locking member 11 and exerts onto the lever arm 51 a spring force which is illustrated by the arrow 54 in FIG. 4. The lever arm 51 thus has substantially a spring action in the direction of the axis 33. In the decoupling situation of the closing head 20 illustrated in FIGS. 1 through 4, however, the spring force 54 is not able to act because the lever arm 51 is secured by locking means 61, 62 in the pivot position of FIG. 4. This position is the "release position" of the locking member 11.

This is possible because the sensing member 12 according to the invention acts as a locking means for the locking member 11. The sensing member 12 is formed as a one-arm lever whose pivot axis 55 is positioned perpendicularly to the pivot axis 53 of the locking member 11. While the sensing member 12 is pivotable in the plane of the drawing FIG. 1 in the direction of the arrow 60, the pivot movement of the locking member 11, indicated by the arrow 57 in FIG. 4, is positioned perpendicularly thereto, i.e., in the drawing plane of FIG. 4. This means that the sensing member 12 is axially pivotable, i.e., parallel to the axis 33 of FIG. 1, but the locking member 11 is radially pivotable relative to the axis 33. The sensing member 12 is also spring-loaded, in particular, by a spring force illustrated by arrow 63 of FIG. 1 which acts substantially axially. For this purpose, a pressure spring 64 is provided which is supported with one end on the bottom of the housing half 19 and with the other end on the sensing member 12. The sensing member 12 is provided with a securing element embodied as a cam 62 which, as a result of the spring-load 63 of the sensing member 12, as illustrated in FIG. 1, is spring-loaded in a direction toward the locking member 11 and, in its release position, engages a cutout 61 which is a counter securing element for the cam 62. The cam 62 has a shoulder with which it contacts a counter shoulder 65 in the interior of the cutout 61. In this release position of the locking member 11, illustrated in FIGS. 1 and 4, the closing head 20 can be coupled in the direction of arrow 32 in the lock 10 or decoupled in the direction of the counter arrow 32' of FIG. 1. However, in the last phase of the coupling movement 32 a release of the locking means 61, 62 results for the following reasons.

Figure 5:
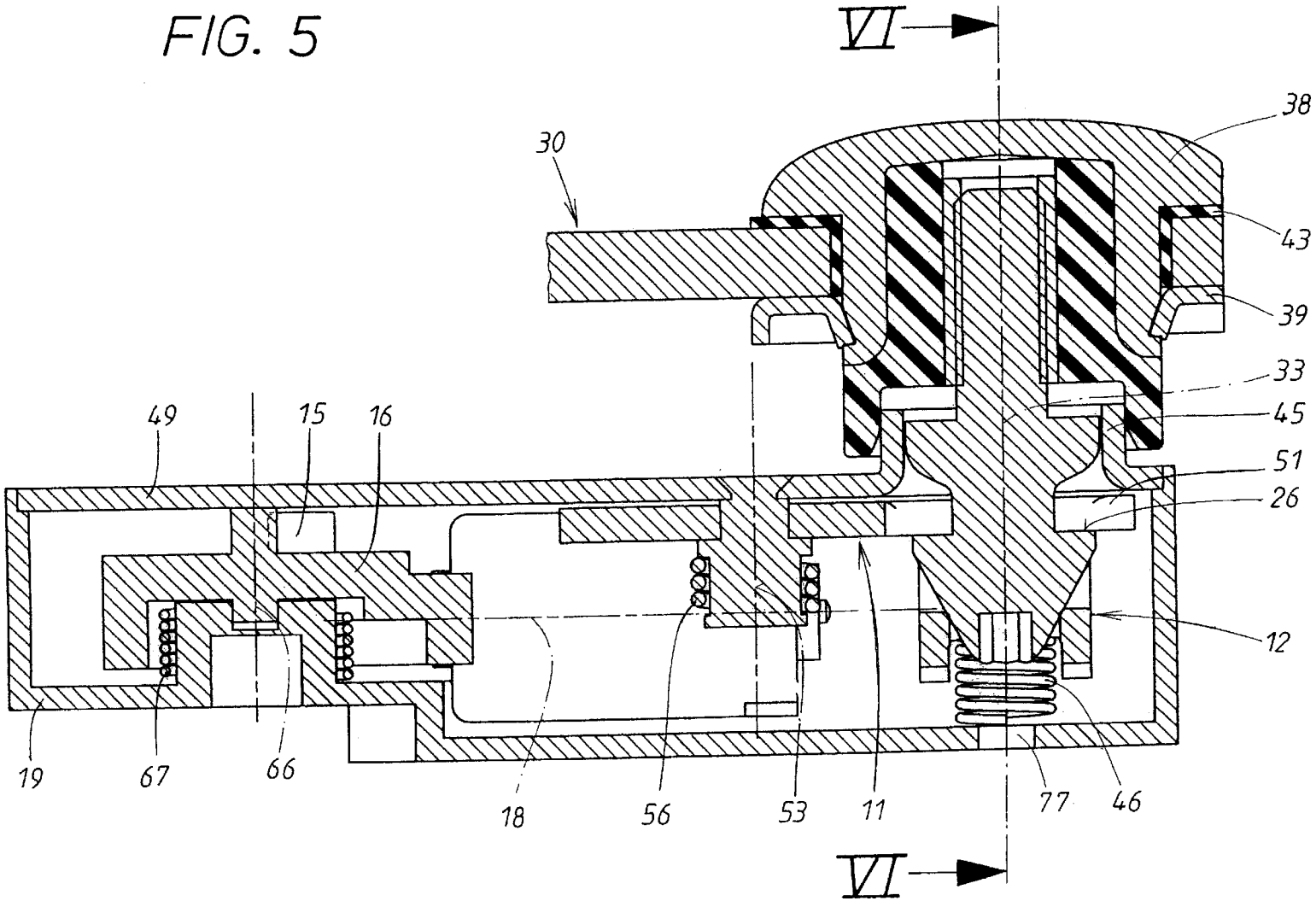
FIG. 5 a further section of the lock along a section line V—V, perpendicular to FIG. 1, of FIG. 3 or FIG. 4 after the closing head of the closure has been coupled.

Upon coupling 32 of the closing head 20 it impacts against the sensing member 12. This results in an axial pivoting away in the direction of the aforementioned pivot movement arrow 60 of FIG. 1 counter to the spring load 63 of the sensing member 12. Accordingly, the cam 62 is pulled out of the cutout 61 in the locking member 11. Now the locking member 11 is free and can be moved radially against the axis 33 in the direction of the force arrow 54 of FIG. 4 acting on it in accordance with the arrow 57 shown there. This results, as is illustrated in FIG. 5, in the lever arm 51 moving into the constriction 22 of the closing head 20. The lever arm 51 engages behind the axial shoulder 26 of the closing head 20. The closing head 20 is secured in its coupling position in the lock 10. The pivot position of the locking member 11 that can be seen in FIGS. 5 and 6 is the "locked position". A decoupling in the direction of the arrow 32' illustrated in FIG. 6 is initially not possible. For this to happen, the aforementioned return member 13 must be activated which is realized here by a motoric actuator 14.

As can be seen in FIGS. 4 and 5, the return member 13 is comprised of a control pin 15 which is seated on a worm wheel 16. The worm wheel 16 is rotatably supported with its worm wheel axle 66 in the housing 19, 49 and is subjected to the effect of a worm wheel spring 67. With suitable rotational stops the worm wheel 16 is secured in the initial rotational position illustrated in FIG. 4 where, when the release position of the locking member 11 is present, normally a radial spacing to the second arm 52 of the locking member 11 is realized. However, when the locking position of the locking member 11, illustrated in FIGS. 5 and 6, is present where the first mentioned working arm 51 of the locking member 11 secures the coupling position of the closing head 20, the second lever arm 52 has pivoted in a direction toward the control pin 15. If needed, the control pin 15 can also serve as a stop for the pivot movement 57 of the locking member 11. In FIGS. 5 and 6, the window 30 is closed.

In the closed position of the rear window 30 a theft alarm can be activated. The inquiry of the theft alarm can be realized by means of the microswitch 70 whose switching actuation is realized by a switch button 71 which is actuated by a switching leaf spring 72 or the like. This microswitch 70 cooperates with the second lever arm 52 of the locking member 11 which acts as a control arm. If it is desired to decouple the closing head 20, the actuator 14 must be activated.

The actuator 14 for the return member 13 is comprised of an actuating member, i.e., a preferably electrically driven motor 18 with a worm 17 which engages the worm wheel 16 of the return member 13. The actuator 14 also includes an actuating switch with suitable control electronics which is connected within the electrical circuit of the motor 18. When the motor 18 is switched on, the worm wheel 16 is rotated by the worm about an angular spacing counter to the spring load 63 of the worm wheel spring 67 acting on the worm wheel 16. This rotational movement is illustrated in FIG. 4 by the rotational arrow 68. In the final rotational position of the worm wheel 16, the control pin 15 reaches the rotational position 15' illustrated in dash-dotted line in FIG. 4. By entraining the control arm 52, the locking member 11 is returned in the direction of arrow 57' of FIG. 4 counter to the acting spring force 54. The locking member 11 reaches thus the release position of FIG. 4. Upon return pivot movement 57' of the working arm 51, the cutout 61 provided thereat again reaches axial alignment with the cam 62 seated on the sensing member 12 so that these elements 61, 62 again engage one another as illustrated in FIGS. 1 and 4. The engagement of the cam 62 in the cutout 61 functions like a snap connection. The sensing members 12 is pivoted back in the direction of arrow 60' of FIG. 1 by its springload 63. Accordingly, the sensing members 12 has activated the locking action for the locking member 11 in its release position. The closing head 20 can be decoupled in the direction of arrow 32' of FIG. 6.

As soon as the control pin has reached its rotational end position 15', the actuator 14 is switched off. This can be carried out automatically via the automatic control. The motor 18 is no longer supplied with current. Now the rotational return force provided by the worm wheel spring 67 exerted in the direction of arrow 69 of FIG. 4 is sufficient to return the worm wheel 16 again into its initial rotational position where the control pin is in the position shown in solid lines in FIG. 4. The provided engagement between the worm wheel 16 and the worm 17 cannot prevent this rotational return movement 68'; the engagement between 16, 17 is not self-locking.

As can be seen in FIGS. 1 and 4, the sensing member 12 has a penetration 73 which is partially engaged by the closing head 20 with its front end 21. The penetration 73 is comprised in the present situation of a slotted hole whose large slotted hole axis 74 expediently is aligned with the plane of the pivot movement 31 (see FIG. 6) of the window 30. This plane of the pivot movement is identical to the section line II—II of FIG. 3. Upon coupling, the closing head 20 is inserted to a partial height 75 of its conical front portion 21 as illustrated in FIG. 6. The insertion depth is determined by the conical shape of the front portion 21 and by the small slotted hole width 76, illustrated in FIG. 3, of the penetration 73. The insertion of the closing head 20 into the penetrations 73, illustrated in FIGS. 5 and 6, allows a reduction of the construction height of the closure housing 10, 49. The aforementioned orientation of the large slotted hole axis 74 takes into consideration the curvature of the pivot movement 31 illustrated in FIG. 6 of the closing head 20 fastened on the window 30. Its forward end 21 can be radially displaced within the slotted hole 73 in the last phase of the coupling action when contacting the sensing member 12. Because the aforementioned pivot movement 60, 60' of the sensing member 12 is carried out in the same plane of the hinged pivot movement, the slotted hole 73 also takes into consideration the corresponding radial displacement between the sensing member 12 and the front end of the closing head 21 resulting from pivoting 60, 60'.

The invention furthermore is characterized in that the closed position of the rear window 30 relative to the stationary rear part 40 of the motor vehicle can be adjusted very precisely. This adjustment can be realized in the coupling situation of the closing head 20 through the lock 10. For this purpose, the housing half 19 of the lock 10 has a penetration 77 for a suitable rotational tool 50. The penetration extends also through possible further lock members on the path to the closing head 20. The slotted hole 73 provided in the sensing member 12 can also serve as a passage. With the tool 50 the axial spacing 42, described above and illustrated in FIG. 2, of the end face 25 of the closing head 20 can be adjusted relative to the window 30. The tool 50 has a plug-in end 59 whose contour profile matches the aforementioned receptacle 29 at the front end face 25 of the closing head 21. By the illustrated plug connection of FIG. 6 of the two connecting halves 29, 59, a torque can be exerted via the rotational tool 50 which results in a defined screwing of the closing head 20 in the threaded receptacle 37 of the bushing 36.

List of Reference Numerals

10 first part of closure, lock
11 locking member, two-arm lever
12 sensing member, one-arm lever
13 return member for 11
14 actuator for 13
15 control pin of 13 (initial position)
15' rotational end position of 15 (FIG. 4
16 worm wheel of 13
17 worm of 14
18 motor of 14
19 first part of housing, housing half
20 second part of closure, closing head
21 forward end portion of 20, conical front end
22 constriction on 20
23 cylindrical portion of 20
24 axial mounting pin of 20
25 front end face of 20
26 axial shoulder on 21
27 slanted control surface on 21
28 gliding slant on 23
29 plug receptacle in 25, first half of plug connection
30 hinged rear window
31 pivot movement path of 30
32 arrow of axial coupling movement of 20 in 10
32' counter arrow for the decoupling movement of 20 from 10 (FIG. 1)
33 axis of 20
34 receptacle in 30 for 24
35 elastomeric material of 36
36 bushing for 24
37 threaded sleeve in 36, first part of screw connection of 20 relative to 30
38 window button on 30
39 securing ring for 38
40 stationary part of the motor vehicle, the rear part
41 coupling opening for 20 in 49
42 axial spacing between 25 and 30
43 seal between 38,34
44 outer thread on 24, second part of the screw connection between 20, 30
45 tubular projection, the guide receptacle on 41
46 cross-section of 23
47 maximum cross-section of 21
48 annular projection on 36 for 45
49 second part of housing on 10, housing cover
50 rotational tool for 20
51 first lever arm of 11, working arm
52 second lever arm on 11, control arm
53 pivot axis on 11
54 arrows of spring force of 51
55 pivot axis of 12
56 locking member spring on 11 (FIG. 4)
57 arrow of pivot movement of 11 (FIG. 4)
58 arrow of alignment movement of 24 in 36 (FIG. 2)
59 plug on 50, second half of a plug connection (FIG. 6)
60 arrow of pivot movement of 12 (FIG. 1)
60' counter arrow of return pivot movement of 12 (FIG. 1)
61 locking means, cutout in 11 for 62, counter securing element
62 locking means, cam on 12 for 61, securing element
63 arrow of spring-load of 12 (FIG. 1)
64 pressure spring for 12
65 counter shoulder of 61 for 62
66 worm wheel axle
67 worm wheel spring for 66
68 arrow of rotation of movement of 15 in 15'
68' counter arrow of rotational return movement of 15' on 15
69 arrow of rotation or return force on 16
70 microswitch for 52
71 switch button on 70
72 switching leaf spring of 70
73 penetration in 12 for 20, slotted hole
74 large slotted hole axis of 73
75 partial height of 21 (FIG. 6)
76 small slotted hole width of 73
77 penetration in 19 for 50 (FIG. 6)

What is claimed is:

1. A closure between a movable part and a stationary part of a door or a flap of vehicles, the closure comprising a lock (10) on the stationary part (40) or the moveable part and further comprising a closing head (20) configured to cooperate with the lock (10) and provided on the moveable part or the stationary part, respectively, and movable axially (32) relative to the lock (10), wherein the closing head (20) comprises an undercut axial shoulder (26) and the lock (10) comprises a radially movable (57, 57') locking member (11) which is spring-mounted in a direction of a movement axis (33) of the locking member (11), wherein the locking member (11) in a coupling situation of the closing head (20) with the locking member (11) engages behind the axial shoulder (26) and is in a locked position, wherein the lock (10) further comprises an axially spring-mounted (63) sensing member (12) and a return member (13) acting on the locking member (11), wherein the sensing member (12) projects into an axial movement path (32) of the closing head (20) and is actuated by the closing head (20), wherein the return member (13) is configured to move the locking member (11) into a release position relative to the closing head (20), in which release position the closing head (20) is configured to be decoupled, wherein the sensing member (12) is a locking means for the locking member (11) and the locking member (11) is secured by the sensing member (12) in the release position until the closing head (20) is decoupled, wherein an axial movement (60) of the sensing member (12) resulting during coupling (32) of the closing head (20) releases a locking action (61, 62) so that a radial spring load (54) acting on the locking member (11) transfers the locking member (11) into the locked position, and wherein the radial return movement (57') of the locking member (11) resulting from actuation of the return member (13) activates the locking action of the sensing member (12) and locks the locking member (11) in the release position;

wherein the sensing member (12) and the locking member (11) are pivotably supported levers having a pivot movement direction (60, 60'; 57, 57'), respectively, wherein the pivot movement directions extend perpendicular to one another.

2. The closure according to claim 1, wherein the closing head (20) conically tapers toward a front end face (25) of the closing head (20)

and wherein the sensing member (12) comprises a penetration (73) receiving a partial height (75) of the closing head (20) in the coupling situation.

3. The closure according to claim 2, wherein the penetration (73) is formed as a slotted hole (73) having a long slotted hole axis (74) positioned in a plane of a pivot movement (31) of the movable part (30).

4. The closure according to claim 1, wherein the closing head (20) comprises an axial mounting pin (24) fastened in a receptacle (34) of the moveable part or the stationary part correlated therewith and wherein the mounting pin (24) is secured in the receptacle in a radially elastic way (35, 58).

5. The closure according to claim 4, wherein the mounting pin (24) is supported in a bushing (36) comprised of elastomeric material (35)

and wherein the bushing (36) is fastened in the receptacle (34).

6. The closure according to claim 1, wherein the closing head (20) is fastened by an axial screw connection (44, 37) on the moveable part or the stationary part correlated therewith, and wherein the lock (10) has a penetration (77) for a rotational tool (50) in order to, with the closing head (20) in the coupled position, be able to axially adjust a mounting position (42) of the closing head (20) on the moveable part or the stationary part.

7. The closure according to claim 6, wherein the penetration (77) in the lock (10) penetrates the lock housing (19) and all parts of the lock which are positioned in a path of the rotational tool (50) in the direction to the coupled closing head (20).

8. The closure according to claim 6, further comprising a plug connection comprising a first plug connection half (29) arranged on a front end face (25) of the closing head (20) and a complementary second plug connection half (59) arranged on the rotational tool (50), wherein the plug connection, in the insertion position of the first and second plug connection halves (29, 59), transmits onto the closing head (20) a torque exerted by the rotational tool (50), and the first plug connection half (29) is axially aligned with the penetration (77).

9. The closure according to claim 1, wherein the lock (10) has a housing with an axial guide receptacle (45) and wherein the closing head (20) has a cylindrical portion (23) received in the axial guide receptacle (45).

10. The closure according to claim 9, wherein, for centering the closing head (20) during insertion into the guide receptacle (45) of the lock, the cylindrical portion has a gliding slant (28) oriented in an axial movement direction (32) of the closing head (20).

11. The closure according to claim 9, wherein the axial guide receptacle (45) is tubular.

12. The closure according to claim 1, wherein the sensing member (12) comprises a securing element (62) and the locking member (11) comprises a counter securing element (61), wherein the securing element (62) and the counter securing element (61) are engaged with one another when the closing head (20) is decoupled and secure the locking member (11) counter to the radial spring load (54) in the release position, and wherein during coupling (32) of the closing head (20) the securing element (62) of the sensing member (12) axially moves at least to such an extent away from the locking member (11) until the securing element (62) leaves the counter securing element (61) and releases the locking member (11).

* * * * *